United States Patent [19]

Leidheiser, Jr. et al.

[11] Patent Number: 4,681,814

[45] Date of Patent: Jul. 21, 1987

[54] CORROSION INHIBITED METAL

[75] Inventors: Henry Leidheiser, Jr., Bethlehem; Hidetaka Konno, Allentown, both of Pa.

[73] Assignee: Lehigh University, Bethlehem, Pa.

[21] Appl. No.: 770,856

[22] Filed: Aug. 29, 1985

Related U.S. Application Data

[60] Division of Ser. No. 548,970, Nov. 7, 1983, Pat. No. 4,563,253, which is a continuation-in-part of Ser. No. 437,148, Oct. 27, 1982.

[51] Int. Cl.[4] ..... B32B 15/04

[52] U.S. Cl. ..... 428/457; 428/658; 428/666

[58] Field of Search ..... 428/457, 469, 658, 666

[56] References Cited

U.S. PATENT DOCUMENTS 4,493,876 1/1985 Birkett et al. ..... 428/457
4,497,877 2/1985 Krijl et al. ..... 428/469

FOREIGN PATENT DOCUMENTS 20375 12/1983 Japan ..... 428/469

OTHER PUBLICATIONS

*J. Electrochemical Soc.*, "Behavior of Salicyladoxime and 8-Hydroxyquinoline at a Copper Electrode," Nioki et al., vol. 122, 855 (1975).

*Mater. Prot. Perform.*, "Chelation Compds. as Cooling Water Corrosion Inhibitors," Weisstuch et al., vol. 10(4), 11 (1971).

*Primary Examiner*—Edith Buffalow
*Attorney, Agent, or Firm*—Ratner & Prestia

[57] ABSTRACT

A metal surface is passivated, or rendered resistant to corrosion, by a dense, intimately adherent overlayer of an insoluble, non-reactive compound comprised of an organic compound complexed with the surface layer of metal of the underlying substrate. The overlayer is formed by first forming a thin oxide layer on the substrate, such as by anodization, and then treating the substrate by anodically depositing and concurrently reacting the complex-forming organic compound. Preferably, the substrate is steel, the anodization and treating baths are borate solutions, and the organic compound is 8-hydroxyquinoline.

17 Claims, No Drawings

CORROSION INHIBITED METAL

GOVERNMENT RIGHTS

The Government has certain rights in this invention pursuant to Contract No. N00014-79-C-0731 awarded by the Office of Naval Research, United States Department of Defense.

Cross Reference to Related Application

This is a divisional application of U.S. patent application Ser. No. 548,970, filed Nov. 7, 1983, now U.S. Pat. No. 4,563,253 of common inventorship and assignment herewith, which is a continuation-in-part of U.S. patent application Ser. No. 437,148, filed Oct. 27, 1982, the details of which are incorporated by reference thereto.

BACKGROUND OF THE INVENTION

This invention pertains to a method of treatment of a metal substrate to provide a corrosion-resistant surface thereon, and to the resulting corrosion-inhibited product of this method. This invention pertains particularly to this method as applied to an iron or steel substrate and as applied to non-ferrous substrates such as copper and zinc.

A wide variety of coating materials and treating methods are known for providing a corrosion-resistant surface on a metallic substrate. Among these are various anodization methods. Iron and steel, for example, may be anodized in a borate bath to impart some degree of corrosion resistance to the metal surface. Such treatments may also be combined with other coatings, such as chromate deposition, to enhance the corrosion resistance of the treated surface. Further, an organic compound, namely glycerin, has also been included in such baths, apparently as a reducing agent for the chromate (see U.S. Pat. Nos. 2,733,199—Wick and 3,296,106—Smith et al). Other known patents disclosing a sodium borate anodization bath are:

U.S. Pat. No. 2,063,197—Schneidewind
U.S. Pat. No. 2,312,076—Cook et al
U.S. Pat. No. 2,780,592—Wick et al
U.S. Pat. No. 2,901,409—De Long
U.S. Pat. No. 2,926,125—Currah et al
U.S. Pat. No. 3,180,807—Quinn
U.S. Pat. No. 3,264,201—Schink et al
U.S. Pat. No. 3,400,058—Ross et al
U.S. Pat. No. 3,477,921—Sanford
U.S. Pat. No. 3,772,165—Yamagishi et al
U.S. Pat. No. 4,209,366—Leroy et al Weisstuch et al., in an article published in Mater. Prot. Perform., 10(4), 11(1971), describe attempted corrosion inhibition of iron by 8-hydroxyquinoline in a corrosion medium simulating cooling water at pH 7 and the formation of an insoluble nonadherent film.

Nicki et al., in an article published in J. Electrochem. Soc. 122, 855(1975), describe a nonadherent copper/8-hydroxyquinoline chelate formed by anodizing copper in an acetate buffer solution containing 8-hydroxyquinoline.

None of these patents and publications, however, appear to disclose the incorporation of any other organic compound in an electrolytic anodization or corrosion resistance-imparting bath, particularly in combination with a borate electrolyte and particularly not including any organic compound known for its ability to form an adherent complex with the underlying metal substrate, and most particularly not including a two-step process for forming a corrosion inhibited product.

The treatment of metal surfaces to retard or prevent corrosion is of great economic interest: thus there is a continuing need for ever more effective corrosion-resistant treatment methods and products of those methods.

It is, therefore, the general object of the present invention to provide a new corrosion inhibiting metal surface treatment method and the new product thereof.

BRIEF DESCRIPTION OF THE INVENTION

The method of this invention comprises first uniformly oxidizing, one means of which is by anodizing a metal surface to be protected in order to produce a thin oxide coating thereon, and subsequently treating the oxide-coated surface in an electrolytic bath, of which the metallic surface to be protected comprises one electrode, the bath including an organic compound which reacts with the oxide coating and forms an insoluble and chemically stable complex with the underlying metal. The present invention also includes the resultant corrosion-inhibited product.

In the preferred embodiment of the present invention, a steel member is passivated by anodization in an electrolytic borate bath and subsequently treated in an electrolytic borate bath including an organic compound capable of forming an insoluble and stable iron complex on the anodized iron surface. The preferred organic compound for this purpose is 8-hydroxyquinoline (hereafter "HO"), which forms a highly insoluble and dense protective layer intimately combined with a surface layer of the steel member to be treated.

In another preferred embodiment of the present invention, the steel member treated in accord with teaching of this invention is further treated by dipping in a solution containing hexavalent chromium resulting in an especially corrosion resistant product.

In another embodiment of the present invention a copper member is first anodized in an electrolytic borate bath and subsequently treated in an electrolytic borate bath including an organic compound.

In another embodiment of the present invention a zinc member is first anodized in an electrolytic borate bath and subsequently treated in an electrolytic borate bath including an organic compound.

DETAILED DESCRIPTION OF THE INVENTION

Providing corrosion resistance or inhibition on the surface of a metal member, by a dense insoluble coating adherent to the surface of the member, is well known. In the present invention, a novel coating of this type is provided. This coating is intimately combined with the surface layer of the metal substrate by virtue of the in-situ formation there of a dense, insoluble metal organic complex. Corrosion protection is accomplished by the electrolytically induced condensation of the organic compound with an underlying oxide layer at the metal surface. The underlying oxide layer can be formed by first anodizing the surface. It is this oxidized surface which is then treated electrolytically with a bath including an organic compound capable of forming such a dense metallic complex.

The underlying oxide surface may also be formed by other chemical processes. For example, a steel surface may be treated with essentially any conventional solution capable of passivating the surface thereof at neutral pH. Phosphate, sodium benzoate, sodium citrate and pyrophosphate are among the types of solutions which may be useful for this purpose.

The method of this invention, and the product of this invention which results from this method, may also be highly useful to protect the surface of a copper substrate upon which is deposited a photoresist, portions of which are subsequently etched. This procedure, which is common in the manufacture of electrical circuits and microcircuits, is becoming increasingly sensitive to the degree of line resolution which can be obtained in the etching process, so as to make ever smaller circuits. Any attack by the etchant on the underlying copper results in a loss of line resolution, to the detriment of the overall process objective. Passivation of the copper surface, in accordance with the present invention may inhibit or prevent such an attack.

Another application of this invention is improved performance of coated metals. Treatment of metal surfaces in accordance with the present invention prior to application of other conventional coatings, such as paint, epoxy and alkyd coatings and the like may reduce the tendency of such coatings to disbond from a metal during corrosion or during cathodic treatments such as electroplating.

Another application of this invention is in the passivation of the surfaces of finely divided metals, such as iron filings or steel powder. Passivation of the surfaces of these particulate materials in accordance with the present invention, may provide a means for forming, by powder metallurgy, metal products which are passivated throughout their microstructure A2 matrix.

Presently, however, the primary application of the present invention is believed to be in the passivation of the surfaces of a steel or iron substrate member. In this regard, "passivation" is considered to be synonymous with treating such surfaces to render them corrosion-resistant or to inhibit cathodic or oxidative attack on such surfaces.

Preferably, this is accomplished by starting with a clean or polished iron or steel member surface and anodizing that surface, then continuing the anodization in a solution which includes an organic compound having certain characteristics.

While a large number of organic compounds have been screened for possible utilization in the present invention with an iron or steel substrate, relatively few have been found to be effective. These include: N-benzoyl-N-phenyl-hydroxylamine, cupferron, diphenylguanidine, 8-hydroxyquinoline, 1-nitroso-2-naphthol, phenylthiourea, salicylamide, salicylanilide, benzohydroxamic acid, 4-hydroxyquinoline, 7-hydroxyquinoline, 5-nitro-8-hydroxyquinoline, 8-nitroquinoline, o-phenylenediamine, salicylaldehyde hydrazone, 1,8-diaminonaphthalene, 8-aminoquinoline, 2,3diaminonaphthalene. Characteristically, these organic compounds or their oxidized product are capable of forming a complex with iron and apparently do form such a complex at the surface of the iron which is treated in accordance with the present invention. Characteristically also, the iron organic complex thus formed provides a coating which is intimately combined with the surface layer of iron on the surface of the member, the complex apparently being formed why reaction between the organic compound in the electrolytic bath and the oxidized ferric compounds on the surface of the anodized substrate. Still further, the metal organic complex thus formed has very low solubility in the aqueous environment and is highly resistant to degradation, either through oxidation or reduction. The surface complex is further characterized by inhibiting cathodic processes, such as the oxygen reduction reaction, in corrosion media thereby permitting a skilled person to readily determine the optimum conditions for practicing the present invention in accord with teachings herein.

In the preferred method of the present invention, the plate to be treated forms the anode in the treating bath so that the complex-forming reaction involves oxidation or reaction of the organic compound with the metal surface. The surface complex so formed is inherently resistive to further oxidation. This is especially important in the passivation of the surface.

In the first treatment step of the preferred method, the surface of the article is provided with a thin oxide layer by anodization in a stirred 0.15M sodium borate solution (pH 8.4) at a first potential ($E_{a1}$) between −0.4V and +2.2V vs. a saturated calomel electrode (SCE) for 2 to 10 min.

Thereafter, the oxide-covered (anodized) article is further anodized at a second potential ($E_{a2}$) between +0.5V and +2.0V for 2 to 10 min. in a borate solution as previously used for anodization, but further including an organic compound, at a concentration on the order of 0.004 to 0.05 mols/liter, which compound, under the influence of an electrolytic current, reacts with the oxide layer and forms metal organic complex which is of low solubility and which is highly resistant to degradation, particularly oxidative attack and reduction.

By way of demonstration of the preferred embodiment of the present invention, a series of tests have been conducted. The procedure followed in these tests and the results obtained are set forth below. Coldrolled SAE 1010 steel panels, 0.5 mm thick, obtained from the O-Panel Co. were cut in the form of rectangles, 1 cm wide and 7.5 cm long. In the subsequent anodization and electrolytic treatment, these samples were immersed to a depth such that the exposed area in the bath was 10 $cm^2$. Samples were abraded with No. 240 emery paper. The steel specimens were anodized in a 0.15M borate solution at pH=8.4 with stirring at 1.0 to 1.4V vs. S.C.E. for 10 minutes after which an exemplary organic compound was added to a concentration of 0.001 to 0.05M and the second anodization step continued for an additional 10 minutes.

Corrosion rate measurements were made in 0.5M sodium chloride −0.15M sodium borate at pH=7.0. The solution was aerated during the measurements by passing air through the solution at a rate of 600 $cm^3$ per min. Gravimetric measurements of the corrosion rate were made in 400 $cm^3$ of solution maintained in a 600 $cm^3$ beaker. Weighed specimens were immersed in aerated solutions for 4 to 48 hours and the loss in weight was determined. Corrosion products were removed from the specimen surface using a nylon test tube brush under running distilled water. Average corrosion rates were determined after 16 hour immersion in the neutral sodium chloride-sodium borate solution.

TABLE 1

| Compound | Conc./mM | $i_a/Am^{-2}$ *1 | $E_{corr}/V$ | $r_{avg}/g\ m^{-2}hr^{-1}$ *2 |
|---|---|---|---|---|
| 8-Aminoquinoline (AQ) | 4 | 0.2 | −0.452 | 0.13*3 |

TABLE 1-continued

| Compound | Conc./mM | $i_a$/Am$^{-2}$*1 | $E_{corr}$/V | $r_{avg}$/g m$^{-2}$hr$^{-1}$*2 |
|---|---|---|---|---|
| Benzohydroxamic acid | 10 | 21 | −0.526 | 0.34 |
| N—Benzoyl-N—phenylhydroxylamine | 4 | 0.3 | −0.434 | 0.48 |
| Cupferron | 10 | 1.3 | −0.553 | 0.39 |
| 1,8-Diaminonaphthalene (DN) | 4 | 0.2 | −0.429 | 0.15*3 |
| 2,3-Diaminonaphthalane | 2 | 0.3 | −0.410 | 0.21 |
| Diphenylguanidine | 4 | 4.2 | −0.448 | 0.23 |
| 4-Hydroxyquinoline | 4 | 17 | −0.415 | 0.26 |
| 7-Hydroxyquinoline | 4 | 0.8 | −0.440 | 0.25 |
| 8-Hydroxyquinoline (HQ) | 4 | 0.3 | −0.422 | 0.10*3 |
| 5-Nitro-8-hydroxyquinoline | 4 | 5.7 | −0.413 | 0.21 |
| 8-Nitroquinoline | 4 | 0.7 | −0.401 | 0.24 |
| 1-Nitroso-2-naphthol | 2 | 0.9 | −0.463 | 0.25 |
| O—Phenylenediamine | 20 | 0.8 | −0.436 | 0.27 |
| Phenylthiourea | 4 | 1.9 | −0.454 | 0.34 |
| Quinoline | 20 | 7.0 | −0.566 | 0.26 |
| Salicylaldehyde hydrazone | 4 | 0.8 | −0.474 | 0.23 |
| Salicylamide | 10 | 8.2 | −0.425 | 0.21 |
| Salicylanilide | 2 | 2.8 | −0.549 | 0.28 |
| Blank | — | 25 | −0.389 | 0.97*3 |

*1Anodic current density at +1.4 V vs. SCE in a borate solution (pH 8.4) containing an organic compound.
*2Average corrosion rate after 16 hr. immersion in an aerated 0.5 M NaCl—0.015 M borate solution (pH 7.0).
*3Median value A summary of the significant results of this test is set forth below in Table 1. Table 1 lists the organic compounds, the concentration of each organic compound used in the test, the anodic current during the second anodization in the presence of the organic compound, the corrosion potential and the average corrosion rate.

In general, these results indicated that each of the compounds listed was effective in producing a significant degree of corrosion inhibition, with 8hydroxyquinoline (HQ), 8-aminoquinoline (AQ) and 1, 8diaminonaphthalene (DN) having been especially effective when used under the conditions of the demonstration test.

In a related test, the corrosion resistance of one aspect of this invention in an acidic medium was determined. Steel specimens were treated as in the above example using 8-hydroxyquinoline (HQ), 8aminoquinoline (AO) and 1,8-diaminonaphthalene (DN), respectively. Average corrosion rates were determined gravimetrically for each treated specimen and an untreated anodized blank after 16 hours immersion in aerated 0.5M NaCl–0.15M borate having pH=3.0. Results are listed in Table 2, below.

TABLE 2

Results of gravimetric measurements after 16 hours' immersion in an aerated 0.5 M NaCl—0.15 M borate solution (pH = 3.0) at room temperature.

| Samples | Average corrosion rate/g m$^{-2}$hr$^{-1}$ |
|---|---|
| HQ-treated | 0.25 ± 0.07*1 |
| AQ-treated | 0.40*2 |
| DN-treated | 0.44*2 |
| Blank | 1.29*2 |

*195% confidence value.
*2Average of three measurements.

A three to five fold reduction in the corrosion rates of steel treated in accord with this invention compared to the corrosion rate of the untreated blank was observed.

In another example of this invention, specimens of cold-rolled SAE 1010 steel panels, 0.5 mm thick, were prepared as described above. Specimens were used either after abrading with No. 240 emery paper or after electropolishing in a 4:1 mixture of glacial acetic acid and perchloric acid. Thus prepared, specimens were anodized in a two-step process:

Step I Anodization at +1.0V vs. SCE in 0.15M borate solution (pH=8.4) for 10 minutes.

Step II Anodization at +1.4V vs. SCE in 0.004M 8-hydroxyquinoline (HO) −0.15M borate solution (pH=8.4) for 10 minutes.

Specimens prepared in this manner are termed "HO-treated". Specimens that were anodized identically in the absence of 8-hydroxyquinoline served as "blanks". Some specimens were post-treated for 10 minutes by dipping in either 0.1M $CrO_3$–0.05M $H_2SO_4$ or 0.01M $K_2Cr_2O_7$ chromate solutions.

Following the two-step treatment the HO-treated specimens and blanks were subjected to a series of tests.

Corrosion rates were determined by gravimetric measurements after immersion in aerated 0.5M NaCl–0.15M borate solutions having pH=7.0 for periods up to 48 hours. Average corrosion rates were determined from weight loss measurements after 16 hours immersion.

Cathodic delamination tests were also performed. Panels were coated with a commercial product (Rust-Oleum primer 7773 and a Rust-Oleum topcoat 7791) using two primer coats and two or three topcoats to yield a coating of thickness 93 μm. or 120 μm. A small defect was made in the coating and the specimen was made the cathode while immersed in a 0.5M sodium chloride solution open to air. In all cases, the cathode potential was potentiostatically maintained at −0.8V. Specimens were dried at room temperature for more than 24 hours to eliminate the effect of wet adhesion failure.

The results of these tests are listed in Table 3 and below.

TABLE 3

Results of Gravimetric Measurements for Steel after 16 Hour Immersion in an Aerated 0.5 M NaCl—0.15 M Borate Solution

| Pre-treatment | Chromate Post-treatment | pH | Average Corrosion Rate $r_{avg}$/g m$^{-2}$hr$^{-1}$ HQ-treated | Blank |
|---|---|---|---|---|
| Abrasion | — | 7.0 | $0.09_0$ ± 0.02 | 0.91 ± 0.13 |
| Abrasion | 0.1 M $CrO_3$— 0.05 M $H_2SO_4$ | 7.0 | $0.02_0$ ± 0.003 | 0.91 ± 0.17 |

95% confidence value

The HQ-treated speicment dipped in 0.1M CrO3-0.05M $H_2SO_4$ exhibited a marked decrease in corrosion rate. Substitution with 0.01M potassium dichromate ($K_2Cr_2O_7$) in the chromate post-treatment produced a similar significant reduction in corrosion rate.

From the measurements of weight loss in sodium chloride at pH=7.0 as a function of time the instantaneous corrosion rates at time, t, for the HO-treated and blank specimens were determined to be:

"HQ-treated" $r_c(t)=0.137t^{-0.16}(g.m.^{-2}h.^{-1})$

"Blank" $r_c(t)=0.668t^{0.06}$

These results indicate that at pH=7.0 the corrosion rate for HO-treated steel decreases with time whereas the corrosion rate of the blank increases with time.

In the cathodic delamination tests the delaminated area increased linearly with immersion time at fixed cathode potential after an initial induction period or delay time. The cathodic delamination rate of the alkyd coating on the HO-treated abraded steel specimen was 40% lower than that of the blank. Furthermore the delay time before delamination began was 80% longer for the HQ-treated specimen compared to the blank.

It should be noted that in the corrosion inhibition tests, optimum experimental conditions were derived for maximum corrosion inhibition by varying $E_{a1}$ in the borate solution and $E_{a2}$ in the borate-hydroxyquinoline solution at various pH were and for different oxidizing times. The criterion used to identify the optimum condition, and which can be employed by a skilled person wishing to practice this invention, was the degree of inhibition as determined by the cathodic polarization curve as measured in aerated 0.5M sodium chlorate −0.15M borate solution. Optimum conditions were $E_{a1}$=0.9–1.8V in a borate solution, $E_{a2}$=1.0–1.7V in a 0.004M 8-hydroxyquinoline-borate solution, pH 7–10, and anodizing time of 10 min. at each potential. In general, the desirable values for $E_{a1}$ are found in the transpassive region of the anodic polarization curve in neutral borate and values for $E_{a2}$ fall within the passive region of the anodic polarization curve in neutral borate solution containing the organic compound.

The teachings of this invention are applicable to nonferrous substrates such as copper and zinc. As an example, a copper specimen was abraded with No. 600 emery paper and subjected to a two-step anodization as follows:

Step 1-Anodication at $E_{a1}$=+1.0V vs. SCE in a 0.15M borate solution (pH=8.4) for 10 minutes.

Step 2-Anodization at $E_{a2}$=+1.4V vs. SCE in 0.004M 8-hydroxyquinoline (HO) −0.15M borate solution (pH=8.4) for 10 minutes.

Measurement of anodic polarization curves indicated that HO functions as a passivator for copper and shifts the anode potential range. After the two-step anodization, a well adhering layer was formed. Cathodic polarization curves of HO treated copper were measured in aerated 0.5M NaCl-0.15M borate at (pH=7.0). Cathodic current densities in both solutions were less for the HQ treated copper compared to a blank. Similar results were obtained using copper that had been etched in 1:1 nitric acid solution.

A demonstration of the teachings of this invention when the substrate is zinc was conducted using chemically polished zinc sheet. Zinc specimens were treated in the two-step process described above with two sets of anodizing conditions:

(a) $E_{a1}$=+2.0V, $E_{a2}$=+2.5V (b) $E_{a2}$=+1.8V, $E_{a2}$=+2.2V

After the second anodization in the bath including 8-hydroxyquinoline, a white or faint yellow layer had formed on the zinc substrate. Electrochemical polarization curves measured in aerated 0.5M NaCl-0.15M borate at pH=7.0 showed that both anodic and cathodic reactions were inhibited on HO-treated zinc compared to the blank.

In general, these results indicate that corrosion inhibiting layers are formed on metals such as copper, zinc, iron and steel why a process comprising a first step of oxidizing the metal by anodizing in an electrolytic bath followed by a second step of anodizing in an electrolytic bath including an organic compound which forms an insoluble, adherent and chemically stable layer over the metal surface. It is also demonstrated that the preferred organic compound, that is, the organic compound producing the highest or most effective degree of corrosion inhibition in these tests was 8-hydroxyquinoline.

The chemical nature of the corrosion inhibiting surfaces of this invention was studied by surface analysis techniques known in the art as x-ray photoelectron spectroscopy (XPS) and Auger electron spectroscopy (AES).

At the present time, it is hypothesized that the first step of the treatment in the present invention is necessary to provide a thin oxide layer on the surface of the metal to be treated. While oxidizing the metal surface is conveniently done by electrolytic anodization, the present invention contemplates alternate means for providing a metal oxide. Among these are: chemical oxidation in aqueous and non-aqueous baths; heat treating in an oxidizing atmosphere, plasma oxidation; ion implantation; and coating the metal surface with an adherent metal oxide by known means such as vacuum evaporation, sputtering, spraying, vapor deposition and the like. In any event, it is apparently this thin oxide surface layer which is attacked in subsequent electrolytic anodization in a bath which includes the metal complex-forming organic compound, such as 8-HQ. The organic compound is apparently oxidized, under the influence of the electrolytic current, and reacts with the metal oxide, displacing some or most of the oxygen to form water, and forming instead at the metal surfce, in intimate combination with the remainder of the metal and oxygen at that surface, the stable and insoluble metal complex passivation layer. Thus, it would appear that with a suitably thin and uniform oxide layer at the metal surface, the subsequent passivation layer may consist of essentially any metal organic complex made from an organic compound deposited electrolytically from an electrolytic bath, which is capable of forming a highly insoluble and stable metal complex with the underlying or host substrate metal.

The XPS, AES, and CEMS (Conversion Electron Mossbauer Spectroscopy) measurements indicate that the metal-organic complex formed when iron or steel is treated with HO in accord with this invention is ferric 8-hydroxyquinolate. It is believed that the oxide layer remaining after formation of the metal complex and situated between the underlying metal and metal complex is very thin, that is, no more than one to three molecular layers thick.

The outermost layer of the corrosion inhibited surface of this invention is believed to be an organic layer whose thickness and chemical composition depend on the metal-complex forming organic compound included in the anodizing bath. Thus, the outermost layer may be comprised of 1 to 2 molecular layers of the metal-complex forming organic compound itself, or it may be relatively thick, that is, greater than 5 or 10 molecular layers of an anodic condensation product of the organic metal-complex forming compound. Alternatively, the outermost layer of the corrosion inhibited surface of this invention comprise no uncomplexed organic compound that can be detected and identified by presently known means. The uncomplexed organic compound is believed to be absent in the case where the corrosion inhibited surface has been post-treated with chromate in accord with the teachings of this invention. Surface analyses of such chromate treated corrosion inhibited steel of this invention indicated that the organic layer which had been present before chromate treatment is essentially removed during chromate treatment. The surface analysis of XPS data futher indicated that the surface after chromate treatment is comprised of at least two different chromium species including hexavalent chromium. The other chromium compound is believed to comprise trivalent chromium, Cr(III). Additional surface analysis including depth profiling indicated that chromium in this invention is not confined to the outermost surface. It is hypothesized that the corrosion inhibited surface that is obtained from chromate post-treatment in accord with this invention is the product of a conversion reaction, viz, the outer layer which is relatively rich in organic material is removed by chromate, and a mixed chromate-chromic oxide forms to fill flaws in the metal-organic complex layer.

While this invention has been described with respect to specific embodiments thereof, it is not limited thereto, and the appended claims are intended to be construed to encompass not only the forms and embodiments of the inventions disclosed and suggested herein, but to such other forms and embodiments as may be devised by those skilled in the art without departure from the true spirit and scope of the invention.

We claim:

1. A metal member comprising a substrate composed of said metal and a corrosion-resistant surface thereon, said corrosion-resistant surfasce comprising a metal oxide layer and a water insoluble, oxidation and reduction-resistant complex compound formed between the metal oxide and an organic compound selected from the group consisting of N-benzoyl-N-phenyl-hydroxylamine, cupferron, diphenylguanidine, 8-hydroxyquinoline, 1-nitroso-2-naphthol, phenylthiourea, salicylamide, and salicylanilide, benzohydroxamic acid, 4-hydroxyqunioline, 7-hydroxyquinoline, 5-nitro-8-hydroxyquinoline, 8-nitroquinoline, o-phenylene diamine, salicylaldehyde hydrozone, 1,8-diaminonaphthalene, 8-aminoquinoline, 2,3-diaminonphthalene and quinoline.

2. A metal member, as recited in claim 1, wherein said organic compound is 8-hydroxyquinoline.

3. A metal member, as recited in claim 1, wherein said metal is zinc.

4. A metal member, as recited in claim 1, wherein said complex compound is 3 to 4 molecular layers thick.

5. A metal member, as recited in claim 1, wherein said corrosion resistant surface further comprises an outermost layer of said organic compound thereon.

6. A metal member, as recited in claim 1, wherein said corrosion resistant surface further comprises an outermost layer of an anodic condensation product of said organic compound.

7. A metal member, as recited in claim 3, wherein said organic compound is 8-hydroxyquinoline.

8. In a coated metal member comprising a metal substrate and a coating thereon, the improvement comprising a corrosion resistant layer underlying said coating, said layer comprising a metal oxide and a water insoluble, oxidation and reduction resistant complex compound formed between the metal oxide and an organic compound, said layer providing a strong bond between said metal substrate and said coating, said organic compound being selected from among the group consisting of N-benzoyl-N-phenyl-hydroxylamine, cupferron, diphenylguandine, 8-hydroxyquinoline, 1-nitroso-2-naphthol, phenylthiourea, salicylamide, salicylanilide, benzohydroxamic acid, 4-hydroxyquinoline, 7-hydroxyquinoline, 5-nitro-8-hydroxyquinoline, 8-nitroquinoline, o-phenylene diamine, salicyaldehyde hydrozone, 1,8-diaminonaphthalene, 8-aminoquinoline, 2,3-diaminonaphthalene and quinoline.

9. A coated metal member, as recited in claim 8, wherein said organic compound is 8-hydroxyquinoline.

10. A metal member, as recited in claim 1, wherein said metal is ion.

11. A metal member, as recited in claim 1, wherein said metal is steel.

12. A metal member, as recited in claim 1, wherein said metal is copper.

13. A metal member, as recited in claim 1, wherein said corrosion resistant surface further comprises at least one chromium compound.

14. A metal member, as recited in claim 13, wherein said at least one chromium compound comprises hexavalent chromium.

15. A metal member, as recited in claim 10, wherein said organic compound is 8-hydroxyquinoline and said complex compound is ferric 8-hydroxyquinolate.

16. A metal member, as recited in claim 11, wherein said organic compound is 8-hydroxyquinoline and said complex compound is ferric 8-hydroxyquinolate.

17. A metal member, as recited in claim 12, wherein said organic compound is 8-hydroxyquinoline.

* * * * *